US005851358A

United States Patent [19]

Kade

[11] Patent Number: 5,851,358

[45] Date of Patent: Dec. 22, 1998

[54] PAPER MAKING MACHINE WITH AN INTEGRAL SUCTION CHAMBER AND AIR/WATER SEPARATOR FOR A DOCTOR ELEMENT

[75] Inventor: Werner Kade, Neenah, Wis.

[73] Assignee: Voith Sulzer Paper Technology North America, Inc., Appleton, Wis.

[21] Appl. No.: 832,202

[22] Filed: Apr. 8, 1997

[51] Int. Cl.[6] ..... D21F 1/00

[52] U.S. Cl. ..... 162/276; 162/281; 162/275; 162/279; 162/364; 162/DIG. 7

[58] Field of Search ..... 162/272, 281, 162/274, 275, 276, 277, 278, 279, 363, 364, 199, DIG. 7

[56] References Cited

U.S. PATENT DOCUMENTS

| | | | |
|---|---|---|---|
| 3,214,327 | 10/1965 | Wicker et al. | 162/205 |
| 3,347,740 | 10/1967 | Goumeniouk | 162/199 |
| 3,951,736 | 4/1976 | Kobayashi | 162/274 |
| 4,267,017 | 5/1981 | North | 162/190 |
| 5,120,401 | 6/1992 | Kiviranta et al. | 162/275 |
| 5,597,449 | 1/1997 | Vestola et al. | 162/199 |

*Primary Examiner*—Peter Chin
*Assistant Examiner*—Jose A. Fortuna
*Attorney, Agent, or Firm*—Taylor & Associates, P.C.

[57] ABSTRACT

The invention is directed to a paper making machine having a wet end associated with a wet fiber web. A forming fabric has a plurality of voids therein and carries liquid from the fiber web. A roll disposed at the wet end of the paper making machine carries the forming fabric. The roll and the forming fabric define a diverging area therebetween which causes liquid in the forming fabric to exit the voids. A doctor back includes a doctor element associated with the roll. A shower provides a liquid output which is directed relative to and lubricates the doctor element. A suction chamber has an at least partially open top and an outlet. The open top is positioned relative to each of the doctor blade and the diverging area to collect liquid from the shower and liquid exiting the voids in the forming fabric in the diverging area. A cyclone separator connected to the suction chamber receives liquid from the suction chamber outlet. A centrifugal blower mounted on the separator generates a vacuum within the suction chamber to draw the liquid within the suction chamber into the separator.

28 Claims, 3 Drawing Sheets

PAPER MAKING MACHINE WITH AN INTEGRAL SUCTION CHAMBER AND AIR/WATER SEPARATOR FOR A DOCTOR ELEMENT

BACKGROUND OF THE INVENTION

1. Field of the invention.

The present invention relates to paper making machines, and, more particularly, to paper making machines having a doctor element bearing against a roll at the wet end of the machine.

2. Description of the related art.

A paper making machine includes a forming fabric, traditionally known as a "wire", in a forming section at the wet end of the machine. The fiber suspension is discharged from a headbox onto the forming fabric. More than one forming fabric may be provided in the forming section of the paper making machine for sequentially contacting and/or carrying the wet fiber web through the wet end of the machine. Each forming fabric typically is in the form of a woven polymeric mesh material with voids defined by the mesh. A portion of the water in the fiber suspension passes through the voids in the forming fabric, while another portion of the water in the fiber suspension may be retained within the voids as a result of adhesion forces between the water and forming fabric.

Each forming fabric is typically in the form of an endless fabric carried by a plurality of rolls. As the forming fabric approaches a roll at running speed, a converging area is defined by the forming fabric and roll. Since the forming fabric and roll are of course not perfectly smooth surfaces, some frictional resistance between the forming fabric, roll and air in the converging area is created which causes a flow of air toward the point of contact between the forming fabric and roll. The flowing air is pushed out through the forming fabric at the contact location between the forming fabric and roll, thus creating a mist of water on the side of the forming fabric opposite the roll. As the forming fabric carried around a portion of the periphery of the roll, some of the water in the voids of the forming fabric is attracted via adhesion forces to the surface of the roll. At the point of separation or divergence between the forming fabric and roll, the adhesion forces between the water and roll cause at least a portion of the water in the forming fabric to be drawn out of the voids in the forming fabric and fall via gravitational force from the diverging area between the forming fabric and roll.

It is known to provide a hood on the side of the forming fabric opposite the roll for the purpose of collecting the mist which is developed as a result of the water being pushed from the voids in the forming fabric at the point of convergence between the roll and forming fabric. The water mist which is drawn into the hood may include a small amount of fiber therein. The fibers may build up on the hood and fall onto the forming fabric. This may result in the formation of a defect in the fiber web carried by the forming fabric.

It is also known to provide a rectangular plenum in the area of divergence between the forming fabric and roll which extends across the width of the forming fabric. The rectangular plenum includes a relatively small, slot-shaped opening which is positioned relatively close to the point of divergence between the forming fabric and roll. A suction pressure within the rectangular plenum causes a part of the water which falls from the point of divergence between the forming fabric and roll to be drawn into the slot-shaped opening for removal through the plenum in an appropriate manner.

It is also known to provide a doctor element, such as a doctor blade, which bears against a roll and cleans the roll by scraping fibers off the roll. A water shower is typically provided in association with the doctor blade for lubricating the doctor blade as it bears against the roll. The shower directs a stream of water against the roll across the width of the doctor blade and on the approach side of the doctor blade. The water inhibits wear and heating as a result of the frictional forces between the doctor blade and roll.

What is needed in the art is an apparatus which more effectively removes both void volume water from the forming fabric and lubricating water from the shower.

SUMMARY OF THE INVENTION

The present invention provides a paper making machine having a compactly arranged suction chamber and cyclone separator, with the suction chamber positioned to receive both void volume water from the forming fabric and lubricating water from a shower associated with a doctor blade.

The invention comprises, in one form thereof, a paper making machine having a wet end associated with a wet fiber web. A forming fabric has a plurality of voids therein and carries liquid from the fiber web. A roll disposed at the wet end of the paper making machine carries the forming fabric. The roll and the forming fabric define a diverging area therebetween which causes liquid in the forming fabric to exit the voids. A doctor back includes a doctor element associated with the roll. A shower provides a liquid output which is directed relative to and lubricates the doctor element. A suction chamber has an at least partially open top and an outlet. The open top is positioned relative to each of the doctor blade and the diverging area to collect liquid from the shower and liquid exiting the voids in the forming fabric in the diverging area. A cyclone separator connected to the suction chamber receives liquid from the suction chamber outlet. A centrifugal blower mounted on the separator generates a vacuum within the suction chamber to draw the liquid within the suction chamber into the separator.

An advantage of the present invention is that the suction chamber is positioned to receive both void volume water from the forming fabric and lubricating water from a shower associated with a doctor blade.

Another advantage is that the suction chamber and cyclone separator are arranged as a compact assembly.

Yet another advantage is that the centrifugal blower is mounted directly on the cyclone separator, further effecting the compactness of the assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
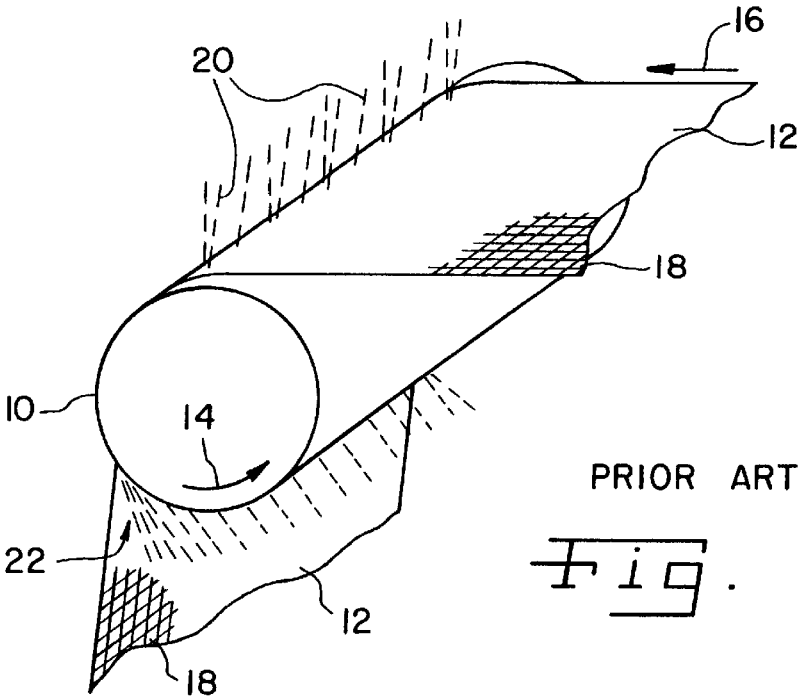
PRIOR ART Fig. 1
FIG. 1 is a fragmentary, perspective view of a portion of a paper making machine including a roll carrying a forming fabric.

Referring now to the drawings and more particularly to FIG. 1, there is shown a fragmentary, perspective view of a portion of a paper making machine including a roll 10 carrying a forming fabric 12. Roll 10 is driven by a suitable drive (not shown) and rotates in the direction indicated by an arrow 14. Forming fabric 12 is carried by roll 10 and moves in the travel direction indicated by an arrow 16. Forming fabric 12 is a polyester mesh with a generally open weave defining a plurality of voids 18 therein, shown exaggerated in FIG. 1. Forming fabric 12 is an endless forming fabric, which is configured to carry and/or engage a wet fiber web (not shown) along a portion of the length thereof. Water 40 from the wet fiber web enters voids 18 in forming fabric 12 and either falls through voids 18 via gravitational force or remains within the void 18 via adhesion forces. As forming fabric 12 approaches roll 10, some of the water in voids 18 of forming fabric 12 exits the forming fabric at the point of contact between roll 10 and forming fabric 12 to form a mist 20 on the side of forming fabric 12 opposite roll 10. As forming fabric 12 is carried around a portion of the periphery of roll 10, some of the water in voids 18 of forming fabric 12 is attracted via adhesion forces to the surface of roll 10. At the point of separation or divergence between forming fabric 12 and roll 10, the adhesion forces between the water and roll 10 cause at least a portion of the water in forming fabric 12 to be drawn out of voids 18 in forming fabric 12 and fall gravitational force from the diverging area 22 between forming fabric 12 and roll 10.

Figure 2:
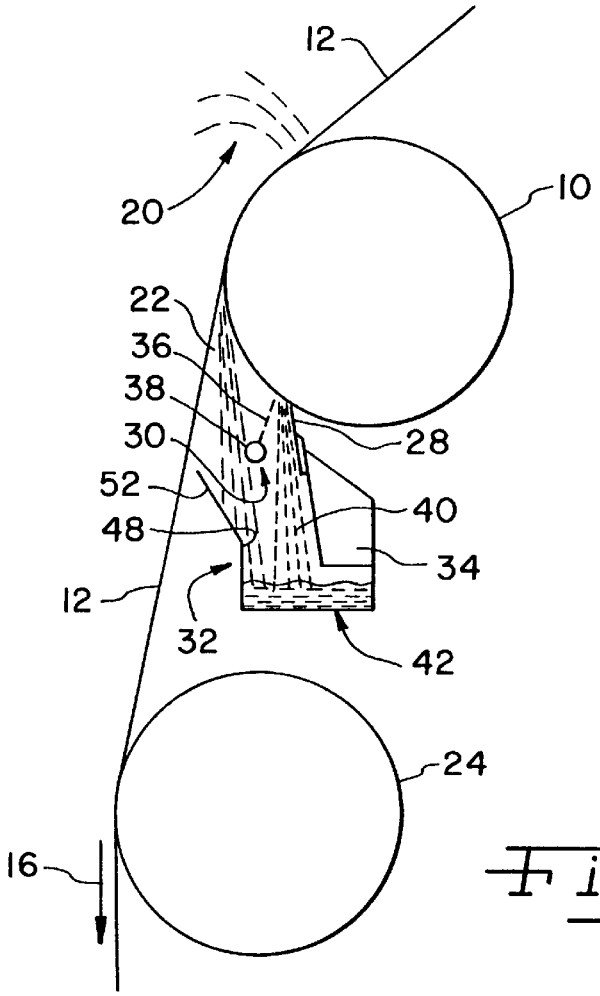
FIG. 2 is a schematic, end view of a portion of a paper making machine including an embodiment of a suction chamber of the present invention positioned below the shower and diverging area between the roll and forming fabric.
Figure 3:
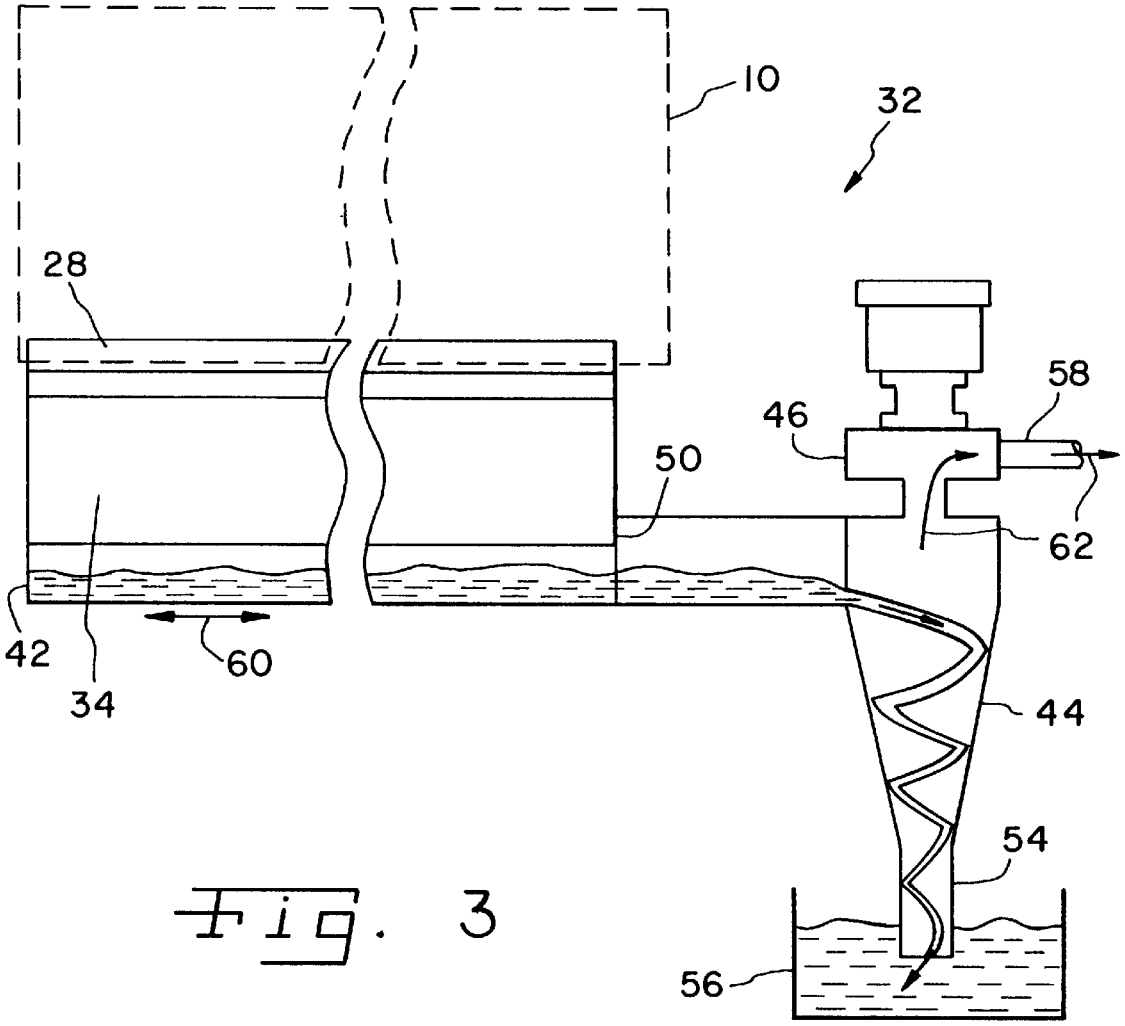
FIG. 3 is a schematic, side view of the suction chamber shown in FIG. 2 connected with an embodiment of a cyclone separator and blower of the present invention.

Referring now to FIGS. 2 and 3, there is shown a paper making machine including roll 10, a roll 24, forming fabric 12, a doctor element 28, a shower 30, and an embodiment of a liquid collection device 32 of the present invention.

The doctor element, such as doctor blade 28, bears against roll 10 and cleans the surface of roll 10 in known manner. Doctor blade 28 is attached to a doctor back 34 which provides structural support to doctor blade 28. Doctor back 34 and doctor blade 28 may be oscillated in opposing longitudinal directions of roll 10 to inhibit uneven wearing between doctor blade 28 and roll 10, as indicated by arrow 60.

Shower 30 provides a liquid output 36 which is directed relative to and configured to lubricate doctor blade 28. More particularly, shower 30 includes a pipe 38 which extends the length of and is disposed generally parallel to doctor blade 28. Pipe 38 includes a plurality of nozzles (not shown) which are spaced apart in the longitudinal direction. The nozzles provide a fan spray of water 36 onto roll 10 at the approach side of doctor blade 28. Water 36 sprayed onto roll 10 lubricates doctor blade 28 and inhibits heating and/or undue wearing between doctor blade 28 and roll 10. Excess water from spray of water 36 is sprayed onto roll 10 from the nozzles. The excess water and water 40 which impinges upon doctor blade 28 falls via gravitational force as indicated at reference number 40. Doctor blade 28 and doctor back 34 are placed relatively close to the diverging area 22 between roll 10 and forming fabric 12 for reasons which will become apparent hereinafter.

Liquid collection device 32 includes a suction chamber 42, an air/water separator 44 and a vacuum generating device 46. Suction chamber 42 has a partially open top 48 and an outlet 50. Open top 48 is positioned relative to each of doctor blade 28 and diverging area 22 to collect water from diverging area 22 and shower 30. More particularly, open top 48 is positioned to collect liquid which exits voids 18 in the forming fabric at diverging area 22, excess water from shower 30 and water from shower 30 which impinges upon doctor blade 28. Suction chamber 42 extends generally parallel to roll 10 and doctor blade 28 and has a length which is approximately the same as or slightly longer than either roll 10 or doctor blade 28. Suction chamber 42 includes a lip 52 which extends toward the forming fabric and terminates relatively close to the forming fabric. The lip assists in catching water which falls from diverging area 22 and directs water into suction chamber 42.

For the sake of compactness, suction chamber 42 and doctor back 34 are connected together in the embodiment shown. Both suction chamber 42 and doctor back 34 may be oscillated together in opposing longitudinal directions 60 relative to roll 10. Suction chamber 42 may be flexibly connected to air/water separator 44 if oscillated in longitudinal directions 60.

Air/water separator 44 is connected to outlet 50 of suction chamber 42 and receives water from suction chamber 42 via outlet 50. In the embodiment shown, air/water separator 44 is configured as a cyclone separator 44; however, other types of air/water separators may be used. Water enters cyclone separator 44 near the top of separator 44 and at a tangent relative to an inner wall of separator 44. As a result, water flows in a spiral manner towards the bottom of cyclone separator 44 and exits through outlet 54 into basin 56.

Vacuum generating device 46 is mounted on top of cyclone separator 44 and generates a vacuum within suction chamber 42 to draw the liquid within suction chamber 42 into cyclone separator 44. In the embodiment shown, vacuum generating device 46 is in the form of a centrifugal blower 46 which is mounted on top of cyclone separator 44. The centrifugal blower blows air from a discharge nozzle 58 into the ambient environment. The air originates from the inlet to suction chamber 42 and is drawn through suction chamber 42, outlet 50 and into separator 44 along with the water from suction chamber 42. The water falls via gravitational force and exits through the outlet 54 of cyclone separator 44. The air, on the other hand, separates from the water and travels through centrifugal blower 46 to the ambient environment, as indicated by arrows 62. If a liquid pump was used to pump the water within suction chamber 42 and create a vacuum within suction chamber 42, fibers within the water would likely build up on the pump and inhibit operation of the pump. On the other hand, the air which is separated from the water in separator 44 and flows through blower 46 is relatively free of fibers.

During use, water from each of diverging area 22 and shower 30 falls into suction chamber 42. The water in suction chamber 42 flows through suction chamber 42, outlet 50 and into separator 44 as a result of the vacuum pressure drawn on suction chamber 42 using centrifugal blower 46. Water 40 enters the top of cyclone separator 44 at a tangent to the inner wall and flows in a spiraling path downward through cyclone separator 44. Water 40 exits outlet 54 of cyclone separator 44 and flows into basin 56. The air which is separated from water 40 at the top of cyclone separator 44 flows through centrifugal blower 46 and into the ambient environment.

Figure 4:
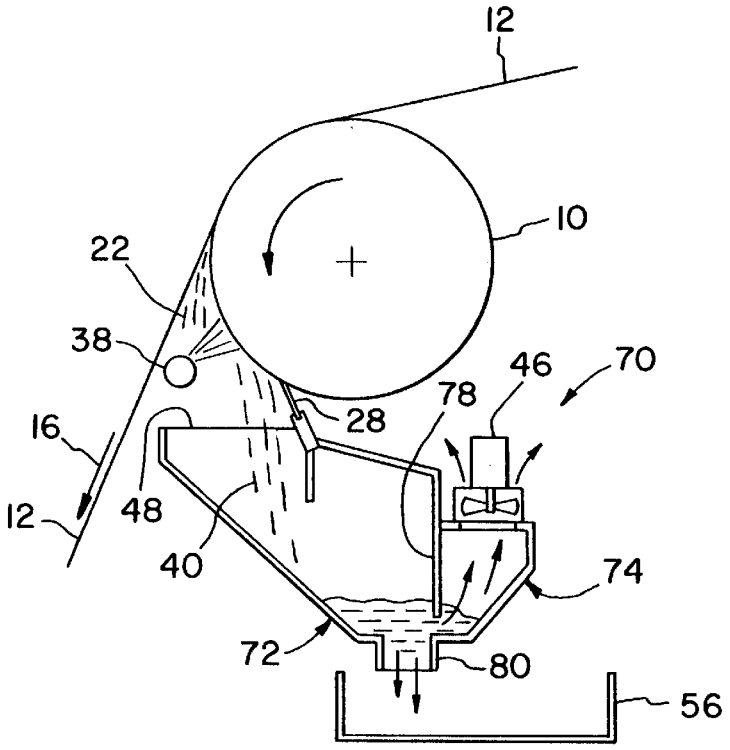
FIG. 4 is a schematic, end view of an embodiment of a suction chamber of the present invention including an integral air/water separator.
Figure 5:
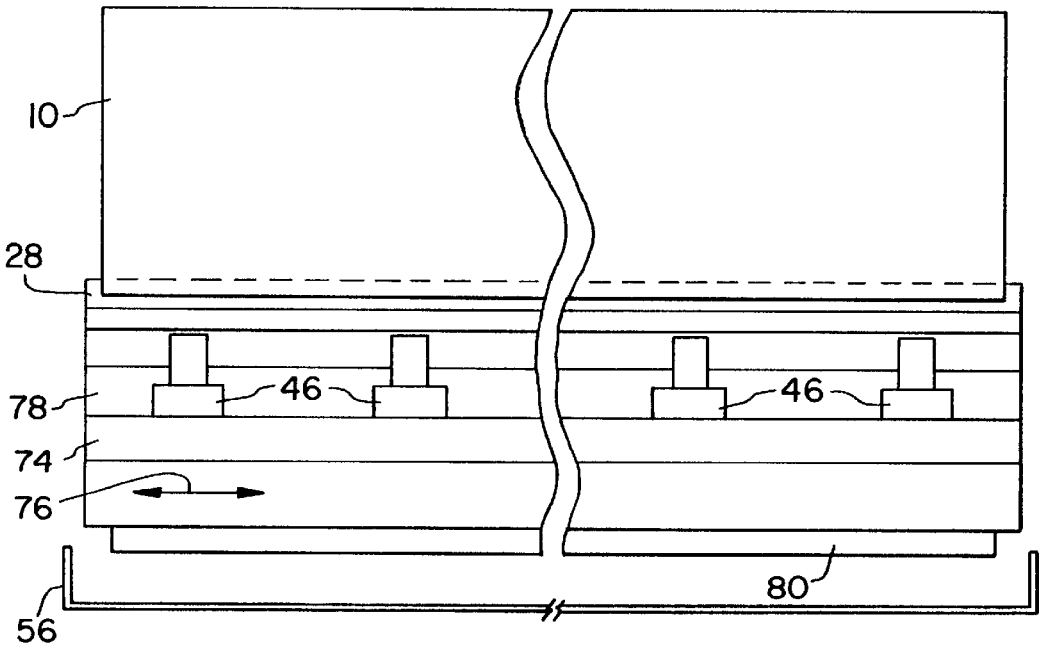
FIG. 5 is a schematic, side view of the suction chamber and integral air/water separator shown in FIG. 4.

Referring now to FIGS. 4 and 5, there is shown another embodiment of a liquid collection device 70 of the present invention. Liquid collection device 70 includes a suction chamber 72 and an integral air/water separator 74. Suction chamber 72 includes an at least partially open top 48 which is positioned below water 40 falling from shower 38 and water from forming fabric 12 falling within diverging area 22, similar to the embodiment of liquid collection device 32 shown in FIGS. 2 and 3. A doctor blade 28 is mounted to suction chamber 72 and bears against roll 10. Suction chamber 72 and doctor blade 28 oscillate in directions parallel to the longitudinal axis of roll 10, as indicated by double-ended arrow 76 in FIG. 5.

In contrast with the embodiment of the liquid collection device 32 shown in FIGS. 2 and 3, liquid collection device 70 shown in FIGS. 4 and 5 is not connected to a separate air/water separator such as a hydrocyclone. Rather, liquid collection device 70 includes an air/water separator 74 which is formed integrally with suction chamber 72. More particularly, suction chamber 72 includes an upstanding wall 78 defining a slot-shaped opening at the bottom thereof in conjunction with a bottom of suction chamber 72. Water from shower 38 and diverging area 22 fall within the open top 48 of suction chamber 72 and flows toward an outlet 80 in the bottom of suction chamber 72 and into basin 56. Air/water separator 74 includes a plurality of vacuum generating devices such as centrifugal blowers 46 which are mounted thereon and induce a vacuum within air/water separator 74. The vacuum within air/water separator 74 in turn induces a flow of water through suction chamber 72 and out the outlet 80. Air and water are both drawn through open top 48 by the induced vacuum. The water flows from outlet 80, and the air is separated from the water within suction chamber 74 and is discharged to the ambient environment from centrifugal blowers 46. Since air/water separator 74 and centrifugal blowers 46 are integrally mounted to suction chamber 72, it will be appreciated that air/water separator 74 and centrifugal blowers 46 also move in oscillating directions indicated by double-ended arrow 76.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper making machine having a wet end associated with a wet fiber web, said paper making machine comprising:

a forming fabric having a plurality of voids therein for carrying liquid from the fiber web;

a plurality of rolls carrying said forming fabric and disposed at the wet end of the paper making machine, one of said rolls and said forming fabric defining a diverging area therebetween which causes liquid in said forming fabric to exit said voids;

a doctor back including a doctor element associated with said one roll;

a shower providing a liquid output which is directed relative to and configured to lubricate said doctor element; and a liquid collection device including:

a suction chamber having an at least partially open top and an outlet, said open top positioned relative to each of said doctor blade and said diverging area to collect liquid from said shower and liquid exiting said voids in said forming fabric in said diverging area;

an air/water separator connected to said suction chamber and receiving liquid from said suction chamber outlet; and a vacuum generating device mounted on said separator and generating a vacuum within said suction chamber to draw the liquid within said suction chamber into said separator.

2. The paper making machine of claim 1, wherein said vacuum generating device comprises a centrifugal blower.

3. The paper making machine of claim 2, wherein said centrifugal blower is mounted on top of said separator.

4. The paper making machine of claim 1, wherein said doctor back is attached to said suction chamber.

5. The paper making machine of claim 1, wherein said at least partially open top of said suction chamber comprises a partially open top.

6. The paper making machine of claim 1, wherein said liquid output from said shower impinges upon one of said one roll and said doctor element.

7. The paper making machine of claim 6, wherein said liquid output from said shower impinges upon said one roll.

8. The paper making machine of claim 1, wherein each of said liquid from said voids in said forming fabric and said liquid from said shower are comprised substantially of water.

9. The paper making machine of claim 1, wherein said separator comprises a cyclone separator.

10. The paper making machine of claim 1, wherein said doctor element comprises a doctor blade.

11. The paper making machine of claim 1, wherein said suction chamber includes a lip extending outwardly therefrom toward said forming fabric.

12. A paper making machine having a wet end associated with a wet fiber web, said paper making machine comprising:

a forming fabric having a plurality of voids therein for carrying liquid from the fiber web;

a roll carrying said forming fabric and disposed at the wet end of the paper making machine, said roll and said forming fabric defining a diverging area therebetween which causes liquid in said forming fabric to exit said voids;

a doctor back including a doctor element associated with said roll;

a shower providing a liquid output which is directed relative to and configured to lubricate said doctor element;

a suction chamber having an at least partially open top and an outlet, said open top positioned relative to each of said doctor blade and said diverging area to collect liquid from said shower and liquid exiting said voids in said forming fabric in said diverging area;

an air/water separator connected to said suction chamber and receiving liquid from said suction chamber outlet; and a centrifugal blower mounted on said separator and generating a vacuum within said suction chamber to draw the liquid within said suction chamber into said separator.

13. The paper making machine of claim 12, wherein said centrifugal blower is mounted on top of said separator.

14. The paper making machine of claim 12, wherein said doctor back is attached to said suction chamber.

15. The paper making machine of claim 12, wherein said at least partially open top of said suction chamber comprises a partially open top.

16. The paper making machine of claim 12, wherein said liquid output from said shower impinges upon one of said roll and said doctor element.

17. The paper making machine of claim 16, wherein said liquid output from said shower impinges upon said roll.

18. The paper making machine of claim 12, wherein each of said liquid from said voids in said forming fabric and said liquid from said shower are comprised substantially of water.

19. The paper making machine of claim 12, wherein said doctor element comprises a doctor blade.

20. The paper making machine of claim 12, wherein said separator comprises a cyclone separator.

21. The paper making machine of claim 12, wherein said suction chamber includes a lip extending outwardly therefrom toward said forming fabric.

22. A paper making machine having a wet end associated with a wet fiber web, said paper making machine comprising:

a forming fabric having a plurality of voids therein for carrying liquid from the fiber web;

a roll carrying said forming fabric and disposed at the wet end of the paper making machine, said roll and said forming fabric defining a diverging area therebetween which causes liquid in said forming fabric to exit said voids;

a doctor element associated with said roll;

a shower providing a liquid output which is directed relative to and configured to lubricate said doctor element;

a suction chamber having an at least partially open top and an outlet, said open top positioned relative to each of said doctor blade and said diverging area to collect liquid from said shower and liquid exiting said voids in said forming fabric in said diverging area;

an air/water separator connected to and in fluid communication with said suction chamber; and a vacuum generating device mounted on said separator and generating a vacuum within said suction chamber to effect a flow of the liquid within said suction chamber from said suction chamber outlet.

23. The paper making machine of claim 22, wherein said air/water separator is integrally connected with and carried by said suction chamber.

24. The paper making machine of claim 22, wherein said vacuum generating device comprises at least one centrifugal blower mounted on said air/water separator.

25. The paper making machine of claim 24, wherein said at least one centrifugal blower comprises a plurality of centrifugal blowers.

26. The paper making machine of claim 22, wherein said doctor element is attached to said suction chamber.

27. The paper making machine of claim 22, wherein said doctor element comprises a doctor blade.

28. The paper making machine of claim 22, wherein said separator comprises a cyclone separator.

* * * * *